United States Patent [19]

Moller

[11] 4,091,957

[45] May 30, 1978

[54] TAPE SEAL FOR CONTAINER

[75] Inventor: Jens L. Moller, Darien, Ill.

[73] Assignee: The Continental Group, Inc., New York, N.Y.

[21] Appl. No.: 826,283

[22] Filed: Aug. 22, 1977

[51] Int. Cl.[2] ..... B65D 41/02

[52] U.S. Cl. ..... 220/260; 220/270; 220/359; 222/541

[58] Field of Search ..... 220/260, 270, 359; 222/541

[56] References Cited

U.S. PATENT DOCUMENTS

| | | | |
|---|---|---|---|
| 3,908,857 | 9/1975 | Chiappe | 220/260 X |
| 3,990,615 | 11/1976 | Kerwin et al. | 222/541 |

*Primary Examiner*—George T. Hall

*Attorney, Agent, or Firm*—John J. Kowalik; Joseph E. Kerwin; William A. Dittmann

[57] ABSTRACT

A rectangular tape seal end closure for closing pour openings in a round end panel of a pressurized container wherein the tape extends to the circular peripheral seaming chuck guide groove. The tape has a pull ring pull folded over the body of the tape and normally would form corners therewith which would encroach upon the chuck guide groove. In this invention, these corners are cut off to clear the chuck groove and novel ribbing reinforcements are provided which reinforce the body of the tape to resist blow-out and which bridge the cut off areas and function to strengthen the tape to counter notch-effect stress concentrations because of cutting off of the corners.

10 Claims, 5 Drawing Figures

TAPE SEAL FOR CONTAINER

DISCUSSION OF THE PRIOR ART

In devices utilizing tapes for closing the pour openings, the tape is usually secured by pressure sensitive adhesives. In closing pressured beverages such as beer or soft drinks, pressure sensitive tapes have not been successful and even heat sealed tapes have more or less consistently failed. The problem at least partially resides in having a single opening defining the pour aperture which has to be placed close to the rim or seam of the can thus minimizing the area to which the adhesive is applied and concurrently limiting the area of tape which can be adhered since the tape has to clear the chuck guide groove. One attempt to solve the problem is shown in U.S. Pat. No. 3,908,857, but is impractical for high speed application and manufacture.

SUMMARY OF THE INVENTION

This invention is directed to a tape seal for the pour opening of a container for pressurized beverages.

A general object of the invention is to provide a novel tape having a rectangular body which is applied diametrically across the top of the round end panel in closing relation to the pour aperture and which has a ring pull portion at one end folded over the body portion and wherein sufficient surface areas of the end panel and body tape are securely adhered particularly in the location between the edge of the pour opening and the chuck guide groove to provide a good seal, the tape being contoured to clear the seaming chuck.

The invention contemplates providing a tape of sufficient width not only to cover the pour aperture, preferably a single hole, but also of such construction as will provide an extensive sealed sanitary area and wherein the structure of the tape permits providing an aperture close to the periphery of the end panel.

A further object is to provide a tape which is particularly useful in the previously described environment having a rectangular body with edge hems along its longitudinal edges to increase its tensile as well as tear or shear strength and of adequate width to form a ring pull at one end of the same diametrical dimension as the width of the body, so that the tape may be easily fed through and fabricated in suitable tape making and applying equipment.

A further object is to provide a novel arrangement of ribbing for reinforcing the tab not only during opening but also during processing.

These and other objects and advantages inherent in and encompassed by the invention will become more readily apparent from the specification and drawings, wherein.

DESCRIPTION OF THE INVENTION

Figure 1:
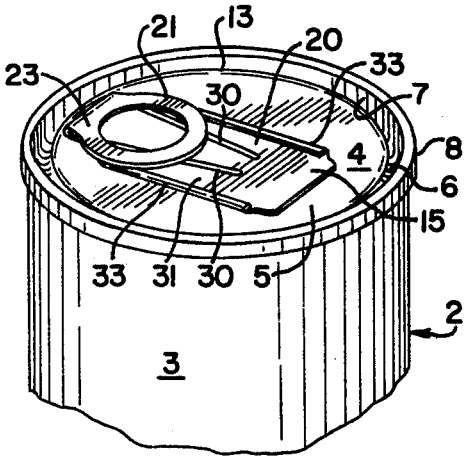
FIG. 1 is a top perspective view of the structure incorporating the invention.

The invention is disclosed in association with a can or container 2 having a cylindrical body 3, an end member 4 including a central flat panel portion 5 circumscribed by an annular chuck guiding groove 6 and a chuck wall 7 which is double seamed at 8 with the upper edge of the can body.

The panel is provided with a pour aperture generally designated 10, preferably as a single opening which extends inwardly from adjacent the peripheral edge 13 of the panel 5.

A tape 15, of a metal foil and plastic such as polypropylene, is used as a closure for the openings. The specific details of such closure are disclosed in U.S. Pat. No. 3,990,615 and the disclosure therein is herein incorporated by reference.

Suffice it to say that the tape is secured by an adhesive to the can top 17 as in the aforesaid application for patent.

The tape herein shown is of a laminate metal foil and plastic and of substantial width and covers a selected area on the can top. The tape comprises a rectangular body portion 20 and at one end has an integral finger-grip portion 21 which is folded over the body portion in a fold bend juncture 23 transverse to the longitudinal extent of the tab.

Figure 2:
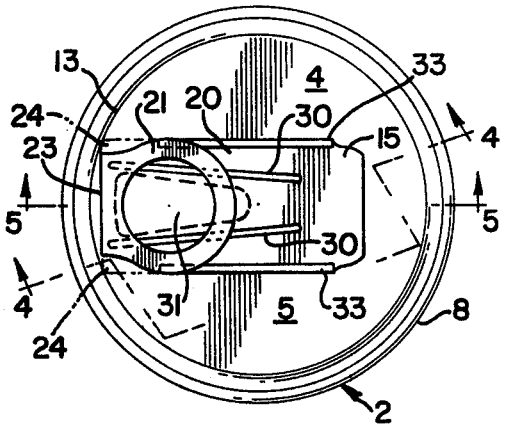
FIG. 2 is a top plan view of the structure showing the tab in folded portion.
Figure 3:
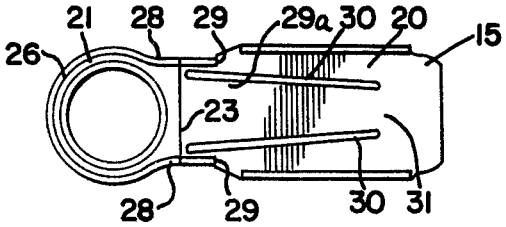
FIG. 3 is a bottom plan view of the tab showing the tab in unfolded position.
Figure 4:
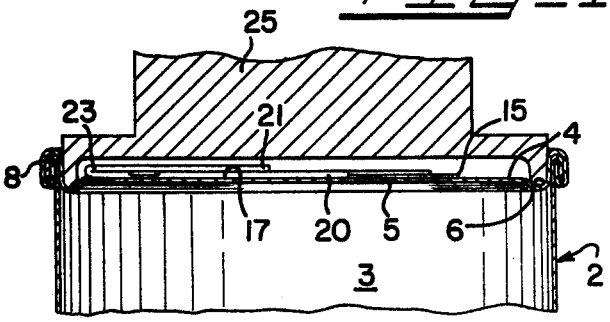
FIG. 4 is an enlarged cross-section taken substantially on line 4—4 of FIG. 2 showing the seaming chuck in position.
Figure 5:
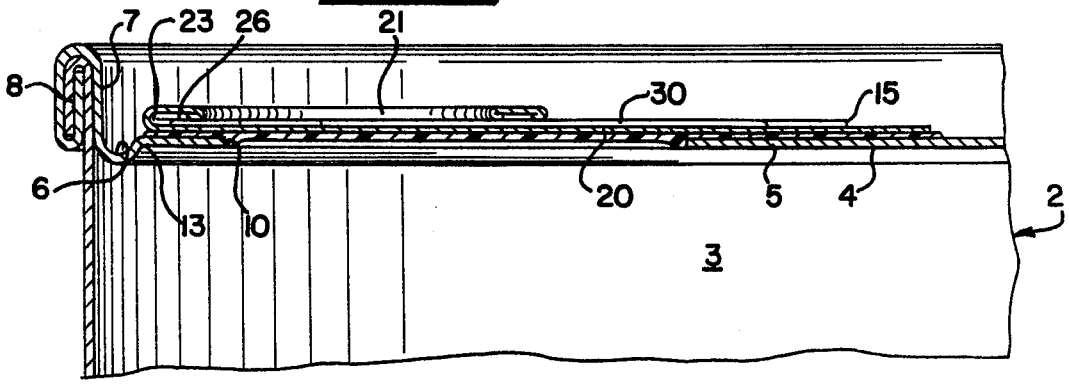
FIG. 5 is an enlarged cross-section on line 5—5 of FIG. 2.

As best seen in FIG. 2, the ends of the bend juncture 23 form right angle corner portions 24, 24 shown (shown in phantom lines in FIG. 2) which would normally project over and encroach upon the chuck guide groove for a chuck 25 (FIG. 4).

A feature of the present invention is providing a tape in which the corner end portions shown in phantom lines at 24, 24 between the pull ring portion and the body portion of the tab are cut off to clear the chuck grooves in the end panel.

In order to compensate for the loss of the material of the portions 24, 24, a hem 26 is provided along the peripheral edge of the ring portion 21, said hem having legs 28, 28 extending past the bend juncture 23. The legs 28, 28 have terminal ends 29, 29 projecting well into the reduced width section 29 of forward end of the reduced width section 29*a* of the body portion 20. Also, a pair of laterally spaced longitudinal ribs 30, 30 are provided the body portion extending from juncture 23 to adjacent the rear of the body portion. These ribs project outwardly of the top surface 31 of the tape and are of U-shape in cross-section and flank the pour-opening-covering section 31 of the body portion and operate as transition ties between the ring portion 21 and the body section 20 of the tape. These ribs are thicker than the remainder of the tape which preferably is a laminate of aluminum foil and polypropylene. During the application and bonding stage to the end panel, the tab being heated to soften the plastic, is pressed against the exterior of the panel so that the plastic not only extrudes into the pour opening, but also into the ribs adding material thereto and substantially strengthening them sufficiently to compensate for the high stress notch effect developed by cutting off the corners between the lift portion of the tab and the body portion. Hems 33, 33 are provided along the lateral edges of the body portion 30.

I claim:

1. A closure for a container end member having a center panel portion and a peripheral chuck wall and a chuck-receiving annular groove in the panel adjacent the chuck wall and having pour opening means disposed in close proximity to said groove;

a tape of rectangular shape having a body portion and a finger-grip lift portion folded over the body portion and forming therewith a fold juncture at one end of the body portion;

means for removably connecting said body portion to said center panel portion in a position disposing said folded edge proximate to said chuck wall chordally with respect to said groove, said tape in the region of said fold juncture being narrower than said body portion and thereat defining stress-concentrating notches in opposite edges of said tape, and means on said body portion and said lift portion reinforcing said tape in said region.

2. The invention according to claim 1 and said means being formed as hems on finger-grip portions.

3. The invention according to claim 2 and said means also being in the form of ribs on said body portion extending lengthwise thereof from said juncture.

4. The invention according to claim 3 and said ribs bowing outwardly intermediate their ends away from each other and displaced inwardly from the lateral edges of the body portion.

5. The invention according to claim 4 and said body portion having converging edge sections extending to said juncture, and said lift portion at said juncture being narrower than said body and having a width clearing said groove.

6. A tape closure for covering a pour opening of a container comprising a rectangular body portion and a lift end portion folded over said body portion and forming a fold juncture with one end portion thereof and at said juncture being narrower than said body portion, said end portion having lateral edges converging from the edges of the body portion to respective lateral edges of said lift portion, said body portion having a pour opening covering section intermediate its ends, and combination tensile and blow-out reinforcing means on said body portion.

7. The invention according to claim 6 and said reinforcing means extending from said juncture toward the other end of the tape and flanking said pour opening covering section.

8. The invention according to claim 7 and said tape comprising a laminate of metal and thermoplastic material.

9. The invention according to claim 8 and said reinforcing means comprising integral ribs offset from said body portion and comprising said plastic and metal materials.

10. The invention according to claim 9 and said ribs providing flow-in space for the plastic material extruded from between the metal and associated can end during application of the tape thereto.

* * * * *